US006197379B1

(12) United States Patent
Minamino

(10) Patent No.: US 6,197,379 B1
(45) Date of Patent: Mar. 6, 2001

(54) MULTILAYER COATING METHOD AND PRODUCTION METHOD OF THERMALLY DEVELOPABLE PHOTOSENSITIVE MATERIAL USING THE SAME

(75) Inventor: Daiki Minamino, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/340,738

(22) Filed: Jun. 28, 1999

(30) Foreign Application Priority Data

Jun. 30, 1998 (JP) ..... 10-184105

(51) Int. Cl.[7] ..... B05D 1/34; B05D 1/36
(52) U.S. Cl. ..... 427/356; 427/358; 118/411
(58) Field of Search ..... 118/411; 427/356, 427/358

(56) References Cited

U.S. PATENT DOCUMENTS 4,113,903 * 9/1978 Choinski ..... 118/411
5,728,430 * 3/1998 Sartor et al. ..... 118/411

* cited by examiner

*Primary Examiner*—Katherine A. Bareford
(74) *Attorney, Agent, or Firm*—Jordan B. Bierman; Bierman, Muserlian and Lucas

(57) ABSTRACT

A multilayer coating method is disclosed. The viscosity of an uppermost layer coating composition is adjusted to at least 0.1 Pa.s during coating, while the viscosity of the other layer coating composition is adjusted to at least 0.03 Pa.s, and a plurality of organic solvent-based coating compositions are coated onto a support employing wet on wet.

16 Claims, 1 Drawing Sheet

MULTILAYER COATING METHOD AND PRODUCTION METHOD OF THERMALLY DEVELOPABLE PHOTOSENSITIVE MATERIAL USING THE SAME

FIELD OF THE INVENTION

The present invention relates to a simultaneous multilayer coating method for an organic solvent-based coating composition and a production method of a thermally developable photosensitive material using the same.

BACKGROUND OF THE INVENTION

Known as a photosensitive photographic material in which organic solvents are employed in composing layer coating compositions is a thermally developable photosensitive material called "Dry Silver". This material commonly comprises a support having thereon two functional layers consisting of a photosensitive layer and a protective layer comprising dyes.

Cited as one method to provide a plurality of functional layers on a support is a successive multilayer coating method in which coating and drying of each layer are repeated, and employed are roll coating methods such as reverse roll coating, gravure coating, etc., or a blade coating, wire bar coating, die coating, etc.

There are simultaneous multilayer coating methods in which employing a plurality of coaters, before drying a previously coated layer, the subsequent layer is applied thereon, and a plurality of layers are simultaneously dried, or employing slide coating or curtain coating, simultaneous multilayer coating is carried out through laminating a plurality of coating compositions on the slide surface.

In the successive multilayer coating method, a plurality of passages through a coating and drying process are required. As a result, abrasion results due to contact with holding rolls in the transporting section, or the functional properties are degraded due to the relatively frequent contact with outside air. Further, coating defects are caused due to foreign matter introduced from the outside. Further, because a plurality of thermal drying processes are provided, from the viewpoint of utilization efficiency of energy, productivity is not good.

In the method in which employing a plurality of coaters, before drying a previously coated layer, the subsequent layer is coated, and a plurality of layers are simultaneously dried, coating defects caused by foreign matter introduced from the outside are markedly decreased. However, because so-called wet on wet coating is carried out, coating defects may be caused due to irregularities of the previously coated layer. The wet on wet coating as described herein denotes that a subsequent coating is carried out before the preceding coating has dried.

In the coating method in which a plurality of coating layers are laminated, coating defects caused by foreign matter introduced from the outside can be minimized. However, mixing between layer tends to result due to the flow, diffusion and density differences of each layer. Specifically in a coating composition employing organic solvents, differences in properties of solvents serves to enhance the mixing between layers, making it difficult to properly realize the function of each layer.

Specifically, in thermally developable photosensitive materials, when mixing occurs between the photosensitive layer and the protective layer, the amount and wavelength of light which passes through the photosensitive layer cannot be controlled. As a result, when the predetermined amount of exposure is given, an excessive shortage of exposure may occur and during subsequent thermal development, the photosensitive layer in a semi-melted state may move up to the surface of the protective layer to deteriorate the properties of the photographic material, and further, to stain the heating roll of the development device.

SUMMARY OF THE INVENTION

In view of the foregoing, the present invention has been accomplished. An object of the present invention is that a plurality of functional layers are coated employing a simultaneous multilayer coating method so that no mixing between layers results. Another object is that a thermally developable photosensitive material is produced employing a simultaneous multilayer coating method.

The invention and embodiment thereof are described. A multilayer coating method comprising a step to form at least two layers in such a manner that at least two coating compositions based on different solvents are coated onto a support, of at least said two layers, the layer other than the layer adjacent to said support is coated onto a layer lower than the layer, before the coating composition of the layer adjacent to the layer has been dried, of at least said two layers, the viscosity of the uppermost layer is at least 0.1 Pa.s during coating and of at least said two layers, the viscosity of the layer other than said uppermost layer is at least 0.03 Pa.s.

In a method according to the Invention, at least two types of said organic solvent-based coating compositions satisfy the formula described below:

$$\mu 1/\mu 2<2$$

wherein $\mu 1$ represents the viscosity of the coating composition at a shear rate of A1 at 25° C., and $\mu 2$ represents the viscosity of the coating composition at a shear rate of A2 at 25° C., and A1<A2.

Desirably, A1 is 100 $S^{-1}$ and A2 is at least 200 $S^{-1}$; it is preferred that A2 is 400 $S^{-1}$. The viscosity of the uppermost layer coating composition is advantageously between 0.1 and 1 Pa.s during coating, and the viscosity of coating compositions of layers other than said uppermost layer is between 0.03 and 0.7 Pa.s during coating. When the viscosity of the coating composition of the uppermost layer is between 0.3 and 0.7 Pa.s during coating, the viscosity of the coating compositions of layers other than said uppermost layer is usefully between 0.2 and 0.6 Pa.s.

The absolute value of the difference between the viscosity of the coating composition of said uppermost layer during coating and the viscosity of the coating composition of the layer other than said uppermost layer during coating is no more than 0.3 Pa.s. Desirably, the shear rate of at least two types of said organic solvent-based coating compositions during coating is between 200 and 500 $S^{-1}$. The Invention also includes a multilayer coating method in which an uppermost layer coating composition having a viscosity of 0.1 to 1 Pa.s during coating, and other coating compositions having a viscosity of 0.03 to 0.7 Pa.s during coating are ejected from the slit of an extrusion-type die coater, laminated, and coated onto a support under a manifold pressure of 10 to 500 kPa during coating.

The Invention further comprises a multilayer coating method in which an upper layer coating composition having a viscosity of 0.1 to 1 Pa.s during coating and a lower layer coating composition having a viscosity of 0.03 to 0.7 Pa.s during coating are ejected from two 50 to 400 $\mu$m slits of an extrusion-type die coater, laminated, and coated onto a support under a manifold pressure of 10 to 500 kPa so as to obtain a total wet thickness of 50 to 200 $\mu$m.

The Invention further includes commencing drying of said at least two layers within 10 seconds after coating at least two different said organic solvent-based coating compositions.

It is also useful to coat said at least two organic solvent-based coating compositions by employing an extrusion-type die coater. The manifold pressure for said at least two organic solvent-based coating compositions is between 10 and 500 kPa.

The other embodiments are described.

In a multilayer coating method in which the viscosity of an uppermost layer coating composition is adjusted to at least 0.1 Pa.s during coating, while the viscosity of the other layer coating composition is adjusted to at least 0.03 Pa.s, and a plurality of organic solvent-based coating compositions are coated onto a support employing wet on wet, each coating composition is ejected from an extrusion-type die coater and laminated, the content of the organic solvent in each coating composition, which is employed in each composition in common, is more than other organic solvents, and the coated material is forwarded to a drying process within 10 seconds after coating.

A multilayer coating method wherein an uppermost layer coating composition, having a viscosity of 0.1 to 1 Pa.s during coating, and a lower layer coating composition, having a viscosity of 0.03 to 0.7 Pa.s during coating, are ejected from a slit of extrusion-type die coater onto a support with the manifold pressureof 10 to 500 kPa.

A multilayer coating method wherein an upper layer coating composition having a viscosity of 0.1 to 1 Pa.s during coating and a lower layer coating composition having a viscosity of 0.03 to 0.7 Pa.s during coating are ejected from two slits having gap of 50 to 400 $\mu$m of an extrusion-type die coater, laminated, and coated onto a support under a manifold pressure of 10 to 500 kPa so as to obtain a total wet thickness of 50 to 200 $\mu$m.

A multilayer coating method wherein an uppermost layer coating composition, having a viscosity of 0.1 to 1 Pa.s during coating, and a lower layer coating composition, having a viscosity of 0.03 to 0.7 Pa.s during coating, are ejected from two slits of an extrusion-type die coater onto a support which is supported on the reverse side, the gap between the surface of said support and the lip of said die coater being adjusted to be 1.1 to 1.9 times as much as the total wet thickness.

A production method for a thermally developable photosensitive material in which employing these multilayer coating methods, coating is carried out in such a manner that of two slits of the extrusion type die coater, the photosensitive coating composition is ejected from the slit which is arranged on the up-stream side in the support-conveying direction and a protective layer coating composition is ejected from the slit arranged on the down-stream side.

BRIEF DESCRIPTION ON DRAWINGS

DETAILED DESCRIPTION OF THE INVENTION

Figure 1:
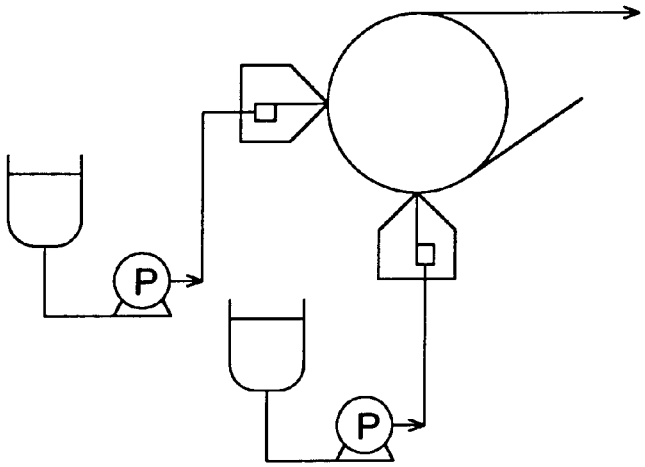
FIG. 1 is a schematic view showing a coating method in Example.

The present inventors discovered that upon coating a plurality of organic solvent-based coating compositions onto a support, employing a wet on wet method, no mixing between layers occurred during the period after coating and before drying, by adjusting the viscosity of the uppermost layer to at least 0.1 Pa.s during coating and the viscosity of other layer coating compositions to at least 0.03 Pa.s during coating.

Such conditions are specifically effective for at least two types of organic solvent-based coating compositions which satisfy the formula described below in which the variation of the viscosity in accordance with the shear rate is relatively small:

$$\mu 1/\mu 2<2$$

wherein $\mu 1$ represents the viscosity of the coating composition at a shear rate of A1 at 25° C., and $\mu 2$ represents the viscosity of the coating composition at a shear rate of A2 at 25° C., and A1<A2. A2 is preferably at least the shear rate during coating. Further, A1 is preferably no more than the shear rate during coating.

In producing a thermally developable photosensitive material, when a photosensitive coating composition and a protective layer are subjected to simultaneous multilayer coating, the shear rate during coating is preferably adjusted to 200 to 500 $S^{-1}$. As a result, A2 is preferably adjusted to at least 200 $S^{-1}$. For example, when the shear rate during coating is adjusted to 400 $S^{-1}$, A1 is preferably adjusted to 100 $S^{-1}$, A2 is preferably adjusted to 400 $S^{-1}$, and A2 is preferably adjusted to 1000 $S^{-1}$. A1 ternatively, A1 is preferably adjusted to 400 $S^{-1}$ and A2 is preferably adjusted to 1000 $S^{-1}$.

Further, mixing between layers can be decreased by adjusting to no more than 0.3 Pa.s of the absolute value of difference between the viscosity of an uppermost layer coating composition and that of other coating composition except for the uppermost layer during multilayer coating.

Next, a method to measure the viscosity of coating compositions will now be described.

The viscosity of the coating composition at optional shear rate can be measured employing a vibration viscometer model CJV2001 manufactured by System Sogo Kaihatsu Co., Ltd. through continual measurement in the range of the shear rate of 100 $S^{-1}$ to 1000 $S^{-1}$ at 25° C.

An extrusion-type die coater, when used, has less open portion than that of a slide coater or curtain coater. As a result, variations in physical properties due to solvent volatilization tends not to occur, and coating layer-forming accuracy is improved.

A flow between layers is generated due to the differences of the volatilization rate of the organic solvent employed in each layer. When the volatilization rate of the organic solvent in a lower layer is greater than that of an upper layer, the rate of movement of the lower layer solvent which volatilizes through the upper layer exceeds the rate of movement of the upper layer solvent. As a result, irregularities are formed and adjacent two layers are mixed. Further, in the reverse case, the organic solvent in the lower layer under drying passes through the upper layer which is just before drying. As a result, irregularities are formed and two adjacent layers are mixed in the same manner as above. Further, phenomena are complicated in the case in which the solid portion concentration of two adjacent layers is different and the amount of the organic solvent to be dried for the coated thickness is different, and it is difficult to minimize the mixing of two adjacent layers.

Upon applying a layer in a liquid state containing dissolved solid materials onto the adjacent layer, when the solid materials are hardly soluble or not soluble in the organic solvent in the adjacent layer, they deposits on the boundary surface to result in the irregularities and turbidity of the coating layer.

Due to the above-mentioned reasons, an organic solvent which is incorporated into each coating layer composition in the greatest amount is preferably the same type of solvent (the content of an organic solvent incorporated into each layer in common is greater than other organic solvents).

Drying is preferably carried out as soon as possible after multilayer coating, and in order to minimize mixing between layers due to flow, diffusion, density differences, etc., it is preferred to introduce the coating layer into a drying process within 10 seconds.

In order to eject an uppermost layer coating composition having a viscosity of 0.1 to 1 Pa.s during coating and another layer coating composition having a viscosity of 0.03 to 0.7 Pa.s during coating from the slits of an extrusion-type die coater, to laminate them, and to coat them onto a support, the manifold pressure during coating is preferably between 10 and 500 kPa., and is more preferably between 20 and 200 kPa. The manifold as described herein is a coating composition-storing portion connected to the slit in the coater. By adjusting the manifold pressure to at least 10 kPa, the degradation of the finished layer thickness distribution due to fluctuation in the amount of a coating composition ejected from the slit caused by the increase in the pressure distribution in the coating crosswise direction in the manifold can be minimized. Specifically, due to small slit resistance like as 10 kPa, a coating composition supplied to the manifold tends to pass through the slit quickly followed by ejection. For example, when the coating composition is supplied to the manifold from the crosswise center, the ejection amount of the coating composition becomes greater, while the ejection amount at crosswise ends becomes less. However, by adjusting the manifold pressure to at least 10 kPa, it is possible to correct the phenomena in which in terms of the coating thickness distribution, the center is high and the end portions are low. Accordingly, it is possible to markedly improve the finished quality. When the manifold pressure is greater than 500 kPa, large load is applied to the liquid-conveying hose between the pump and the die coater, and the connection portion. Therefore, it is necessary to make the facilities more robust than actually required. However, by adjusting the manifold pressure to no more than 500 pKa, it is not required to construct the specially robust facilities and is possible to carry out excellent coating at low cost.

In order to coat an upper layer coating composition having a viscosity of 0.1 to 1 Pa.s during coating and a lower layer coating composition having a viscosity of 0.03 to 0.7 Pa.s employing an extrusion-type die coater, the opening of each slit is preferably between 50 and 400 $\mu$m. By adjusting the opening to at least 50 $\mu$m, it is possible to control the increase in the flow resistance and the excessive increase the manifold pressure. Furthermore, by adjusting the opening to no more than 400 $\mu$m, it is possible control the decrease in said flow resistance and the excessive decrease in said manifold pressure.

The slit length from the manifold of an extrusion-type die coater to the lip is preferably between 10 and 100 mm.

When coating compositions are ejected from two slits of the extrusion-type die coater, laminated, and coated onto a support which is supported on the reverse side, the gap between the surface of said support and the lip of the die coater is preferably between 1.1 and 1.9 times as much as the total wet layer thickness, and is more preferably between 1.3 and 1.8 times. By adjusting the gap to at least 1.1 times, it is possible to control the excessive increase in stationary liquid accumulation called bead which is formed in the liquid-contacting portion between the lip and the surface of the support and to decrease the amount of the coating composition which flows down along the wall surface of the die, while all the coating composition is not taken away by web. In such a manner, it is possible to control the excessive growth of the bead and to decrease the amount of the coating composition which flows down along the wall surface of the die coater. Accordingly, it becomes possible to theoretically grasp the relationship between the supply amount of the coating composition and the coating thickness, and it is then possible to decrease variations of the relationship between the ejection amount and the coating amount with time. As a result, it is possible to manufacture products with uniform quality. Further, it is possible control the decrease in the thickness of the coating layer which is coated in the portion in which—in the crosswise direction in which the coating composition flows down along the wall surface of the die coater. As a result, it is possible to maintain the targeted quality. Specifically, for example, it is possible to decrease the formation of streak-like unevenness on the coating layer. Further, by adjusting the gap to no more than 1.9 times, it is possible to control the shortage of the liquid amount of the bead to make it possible to carry out stable coating and to improve coatability. Specifically, for example, it is possible to decrease the formation of non-coating of the layer, etc.

In order to produce a thermally developable photosensitive material employing the multilayer coating method of the present invention, of two slits of an extrusion-type die coater, a photosensitive coating composition may be ejected from the slit arranged on the upstream position in the support-forwarding direction and a protective layer may be ejected from the slit positioned at the downstream.

Thermally developable photosensitive materials, which form photographic images employing a thermally developable processing method, are disclosed, for example, in U.S. Pat. Nos. 3,152,904 and 3,457,075, and D. Morgan "Dry silver Photographic Materials" (Handbook of Imaging Materials, Marcel Dekker, Inc., page 48, 1991), D. Morgan and B. Shely, "Thermally Processed Silver Systems" (Imaging Processes and Materials, Neblette 8th edition, edited by Sturge, V. Walworth, A. Shepp, page 2, 1969). The thermally developable photosensitive materials are developed at high temperatures, for example, 80–140° C. to form images, preferably without fixing process. In this instance silver halide and organic silver salt are not removed and remain in the photosensitive material.

Transmittance of the developed photosensitive material including a support at 400 nm is preferably 0.2 or less, and more preferably 0.02–b 0. The silver halide grains function as a light sensor. In the present invention, in order to minimize the translucence after image formation and to obtain excellent image quality, the average grain size is preferably minute. The average grain size is preferably not more than 0.1 $\mu$m; is more preferably between 0.01 and 0.1 $\mu$m, and is most preferably between 0.02 and 0.08 $\mu$m. The average grain size as described herein implies the ridge line length of a silver halide grain when it is a so-called regular crystal which is either cubic or octahedral. When the grain is not a regular crystal, for example, when it is a spherical, cylindrical, or tabular grain, the grain size is the diameter of a sphere having the same volume as each of those grains.

Furthermore, silver halide is preferably monodispersed. The monodisperse as described herein means that the degree of monodispersibility obtained by the formula described below is not more than 40 percent. The more preferred grains are those which exhibit the degree of monodispersibility is not more than 30 percent, and the particularly preferred grains are those which exhibit a degree of monodispersibility is between 0.1 and 20 percent.

Degree of monodispersibility=(standard deviation of grain diameter)/(average of grain diameter)×100 As for the silver halide grain shape, a high ratio occupying a Miller index (100) plane is preferred. This ratio is preferably at least 50 percent; is more preferably at least 70 percent, and is most preferably at least 80 percent. The ratio occupying the Miller index (100) plane can be obtained based on T. Tani, J. Imaging Sci., 29, 165 (1985) in which adsorption dependency of a (111) plane and a (100) plane is utilized.

Furthermore, another preferred silver halide shape is a tabular grain. The aspect ratio of the tabular grain is preferably 2–100, more preferably between 3 and 50. The grain diameter is preferably not more than 0.1 $\mu$m, and is more preferably between 0.01 and 0.08 $\mu$m. These are described in U.S. Pat. Nos. 5,264,337, 5,314,789, 5,320,958, and others, by which desired tabular grains can readily be prepared.

The composition of silver halide includes silver chloride, silver chlorobromide, silver chloroiodobromide, silver bromide, silver iodobromide, or silver iodide.

The photographic emulsion can be prepared employing methods described in P. Glafkides, "Chimie et Physique Photographique" (published by Paul Montel, 1967), G. F. Duffin, "Photographic Emulsion Chemistry" (published by The Focal Press, 1966), V. L. Zelikman et al., "Making and Coating Photographic Emulsion" (published by The Focal Press, 1964), etc.

Any of several acid emulsions, neutral emulsions, ammonia emulsions, and the like may be employed. Furthermore, when grains are prepared by allowing soluble silver salts to react with soluble halide salts, a single-jet method, a double-jet method, or combinations thereof may be employed.

The resulting silver halide may be incorporated into an image forming layer utilizing any practical method, and at such time, silver halide is placed adjacent to a reducible silver source.

The silver halide may be prepared by converting a part or all of the silver in an organic silver salt formed through the reaction of an organic silver salt with halogen ions into silver halide. Silver halide may be previously prepared and the resulting silver halide may be added to a solution to prepare the organic silver salt, or combinations thereof may be used, however the latter is preferred.

Generally, the content of silver halide in organic silver salt is preferably between 0.75 and 30 weight percent.

Silver halide grain is preferably comprised of ions of metals or complexes thereof, in transition metal belonging to Groups VIB, VIIB, VIII and IB of the Periodic Table. As the above-mentioned metals, preferred are W, Fe, Co, Ni, Cu, Ru, Rh, Pd, Re, Os, Ir, Pt and Au.

These metals may be incorporated into silver halide in the form of complexes. In the present invention, regarding the transition metal complexes, six-coordinate complexes represented by the general formula described below are preferred.

General formula $(ML_6)^m$ wherein M represents a transition metal selected from elements in Groups VIB, VIIB, VIII, and IB of the Periodic Table; L represents a coordinating ligand; and m represents 0, −1, −2, or −3.

Specific examples represented by L include halides (fluorides, chlorides, bromides, and iodides), cyanides, cyanates, thiocyanates, selenocyanates, tellurocyanates, each ligand of azido and aquo, nitrosyl, thionitrosyl, etc., of which aquo, nitrosyl and thionitrosyl are preferred. When the aquo ligand is present, one or two ligands are preferably coordinated. L may be the same or different.

The particularly preferred specific example of M is rhodium (Rh), ruthenium (Ru), rhenium (Re) or osmium (Os).

Specific examples of transition metal ligand complexes are described below.

1: $[RhCl_6]^{3-}$
2: $[RuCl_6]^{3-}$
3: $[ReCl_6]^{3-}$
4: $[RuBr_6]^{3-}$
5: $[OsCl_6]^{3-}$
6: $[IrCl_6]^{4-}$
7: $[Ru(NO)Cl_5]^{2-}$
8: $[RuBr_4(H_2O)]^{2-}$
9: $[Ru(NO)\ (H_2O)Cl_4]-$
10: $[RhCl_5(H_2O)]^{2-}$
11: $[Re(NO)Cl_5]^{2-}$
12: $[Re(NO)CN_5]^{2-}$
13: $[Re(NO)ClCN_4]^{2-}$
14: $[Rh(NO)_2Cl_4]^-$
15: $[Rh(NO)\ (H_2O)Cl_4]^-$
16: $[Ru(NO)CN_5]^{2-}$
17: $[Fe(CN)_6]^{3-}$
18: $[Rh(NS)Cl_5]^{2-}$
19: $[Os(NO)Cl_5]^{2-}$
20: $[Cr(NO)Cl_5]^{2-}$
21: $[Re(NO)Cl_5]^-$
22: $[Os(NS)Cl_4(TeCN)]^{2-}$
23: $[Ru(NS)Cl_5]^{2-}$
24: $[Re(NS)Cl_4(SeCN)]^{2-}$
25: $[Os(NS)Cl(SCN)_4]^{2-}$
26: $[Ir(NO)Cl_5]^{2-}$
27: $[Ir(NS)Cl_5]^{2-}$

One type of these metal ions or complex ions may be employed and the same type of metals or the different type of metals may be employed in combinations of two or more types.

Generally, the content of these metal ions or complex ions is suitably between $1\times10^{-9}$ and $1\times10^{-2}$ mole per mole of silver halide, and is preferably between $1\times10^{-8}$ and $1\times10^{-4}$ mole.

Compounds, which provide these metal ions or complex ions, are preferably incorporated into silver halide grains through addition during the silver halide grain formation. These may be added during any preparation stage of the silver halide grains, that is, before or after nuclei formation, growth, physical ripening, and chemical ripening. However, these are preferably added at the stage of nuclei formation, growth, and physical ripening; furthermore, are preferably added at the stage of nuclei formation and growth; and are most preferably added at the stage of nuclei formation.

The addition may be carried out several times by dividing the added amount. Uniform content in the interior of a silver halide grain can be carried out. As described in Japanese Patent Publication Open to Public Inspection No. 63-29603, 2-306236, 3-167545, 4-76534, 6-110146, 5-273683, etc., incorporation can be carried out so as to result in distribution formation in the interior of a grain.

These metal compounds can be dissolved in water or a suitable organic solvent (for example, alcohols, ethers, glycols, ketones, esters, amides, etc.) and then added. Furthermore, there are methods in which, for example, an aqueous metal compound powder solution or an aqueous solution in which a metal compound is dissolved along with NaCl and KCl is added to a water-soluble silver salt solution during grain formation or to a water-soluble halide solution; when a silver salt solution and a halide solution are simultaneously added, a metal compound is added as a third solution to form silver halide grains, while simultaneously mixing three solutions; during grain formation, an aqueous solution comprising the necessary amount of a metal compound is placed in a reaction vessel; or during silver halide preparation, dissolution is carried out by the addition of other silver halide grains previously doped with metal ions or complex ions. Specifically, the preferred method is one in which an aqueous metal compound powder solution or an aqueous solution in which a metal compound is dissolved along with NaCl and KCl is added to a water-soluble halide solution.

When the addition is carried out onto grain surfaces, an aqueous solution comprising the necessary amount of a metal compound can be placed in a reaction vessel immediately after grain formation, or during physical ripening or at the completion thereof or during chemical ripening.

The silver halide grains may be subjected to desalting by noodle method, flocculation method, ultrafiltration method, electrical dialysis method and so on.

The silver halide grains are preferably subjected to chemical sensitization. The chemical sensitization includes sulfur sensitization, selenium sensitization, tellurium sensitization, noble metal sensitization, reduction sensitization. Two or more sensitization methods may be employed in combination. As for sulfur sensitization thiosulfates, thioureas, inorganic sulfur etc. may be employed. Examples of compounds employed for selenium sensitization and tellurium sensitization are described in JAPANESE PATENT PUBLICATION OPEN TO PUBLIC INSPECTION NO. 9-230,527 A. Examples of compounds employed for noble metal sensitization include chloro auric acid, potassium chloroaurate, potassium aurithiocyanate, gold sulfide, gold selenide, or compounds described in U.S. Pat. No. 2,448,060, U.K. Patent 618,061, etc. As specific compounds for the reduction sensitization method, employed are ascorbic acid, thiourea dioxide, stannous chloride, hydrezine derivatives, borane compounds, silane compounds, polyamine compounds, etc. In addition, the reduction sensitization can be carried out. The reduction sensitization can also be carried our by keeping the pH and pAg of an emulsion at not less than 7 and not more than 8.3, respectively. Reduction sensitization can be performed by introducing single addition part of the silver ion during preparation of silver halide grains.

The organic silver salts are reducible silver sources and preferred are organic acids and silver salts of hetero-organic acids having a reducible silver ion source, specifically, long chain (having from 10 to 30 carbon atoms, but preferably from 15 to 25 carbon atoms) aliphatic carboxylic acids and nitrogen-containing heterocylic rings.

Organic or inorganic silver salt complexes are also useful in which the ligand has a total stability constant for silver ion of 4.0 to 10.0.

Examples of preferred silver salts are described in Research Disclosure, Items 17029 and 29963, and include the following; organic acid salts (for example, salts of gallic acid, oxalic acid, behenic acid, stearic acid, palmitic acid, lauric acid, etc.); carboxyalkylthiourea salts (for example, 1-(3-carboxypropyl)thiourea, 1-(3-carboxypropyl)-3,3-dimethylthiourea, etc.); silver complexes of polymer reaction products of aldehyde with hydroxy-substituted aromatic carboxylic acid (for example, aldehydes (formaldehyde, acetaldehyde, butylaldehyde, etc.)), hydroxy-substituted acids (for example, salicylic acid, benzoic acid, 3,5-dihydroxybenzoic acid, 5,5-thiodisalicylic acid, silver salts or complexes of thioenes (for example, 3-(2-carboxyethyl)-4-hydroxymethyl-4-(thiazoline-2-thioene and 3-carboxymethyl-4-thiazoline-2-thioene)), complexes of silver with nitrogen acid selected from imidazole, pyrazole, urazole, 1.2,4-thiazole, and 1H-tetrazole, 3-amino-5-benzylthio-1,2,4-triazole and benztriazole or salts thereof; silver salts of saccharin, 5-chlorosalicylaldoxime, etc.; and silver salts of mercaptides.

The preferred organic silver salts are silver behenate, silver stearate, and silver arachidate. These silver salts may be used in combination.

Organic silver salts can be prepared by mixing a water-soluble silver compound with a compound which forms a complex with silver, and employed preferably are a normal precipitation, a reverse precipitation, a double-jet precipitation, a controlled double-jet precipitation as described in Japanese Patent Publication Open to Public Inspection No. 9-127643, etc.

The organic silver salts have an average grain diameter of 1 $\mu$m and are monodispersed. The average diameter of the organic silver salt as described herein is, when the grain of the organic salt is, for example, a spherical, cylindrical, or tabular grain, a diameter of the sphere having the same volume as each of these grains. The average grain diameter is preferably between 0.01 and 0.8 $\mu$m, and is most preferably between 0.05 and 0.5 $\mu$m. The monodisperse as described herein is the same as silver halide grains and preferred monodispersibility is between 1 and 30 percent. It is preferable that not less than 60% of total number of the organic silver grains is occupied with the tabular grains having the tabular ratio of not less than 3. For modifying the shape of the organic silver salt, the crystals may be pulverized and dispersed by means of ball mill etc. with binder and surfactant etc.

The total amount of silver halides and organic silver salts is preferably between 0.3 and 2.5 g per $m^2$ in terms of silver amount. When these are prepared within this range, high contrast images can be obtained. Furthermore, the amount of silver halides to that of total silver is not more than 50 percent by weight; is preferably not more than 25 percent, and is more preferably between 0.1 and 15 percent.

A reducing agent is preferably incorporated into the thermally developable photosensitive material. Examples of suitable reducing agents are described in U.S. Pat. Nos. 3,770,448, 3,773,512, and 3,593,863, and Research Disclosure Items 17029 and 29963, and include the following.

Aminohydroxycycloalkenone compounds (for example, 2-hydroxypiperidino-2-cyclohexane); esters of amino reductones as the precursor of reducing agents (for example, pieridinohexose reducton monoacetate); N-hydroxyurea derivatives (for example, N-p-methylphenyl-N-hydroxyurea); hydrazones of aldehydes or ketones (for example, anthracenealdehyde phenylhydrazone; phosphamidophenols; phosphamidoanilines; polyhydroxybenzenes (for example, hydroquinone, t-butylhydroquinone, isopropylhydroquinone, and (2,5-dihydroxy-phenyl) methylsulfone); sulfhydroxamic acids (for example, benzenesulfhydroxamic acid); sulfonamidoanilines (for example, 4-(N-methanesulfonamide)aniline);
2-tetrazolylthiohydroquinones (for example, 2-methyl-5-(1-phenyl-5-tetrazolylthio)hydroquinone); tetrahydroquinoxalines (for example, 1,2,3,4-tetrahydroquinoxaline); amidoxines; azines (for example, combinations of aliphatic carboxylic acid arylhydrazides with ascorbic acid); combinations of polyhydroxybenzenes and hydroxylamines, reductones and/or hydrazine; hydroxamic acids; combinations of azines with sulfonamidophenols; α-cyanophenylacetic acid derivatives; combinations of bis-β-naphthol with 1,3-dihydroxybenzene derivatives; 5-pyrazolones, sulfonamidophenol reducing agents, 2-phenylindane-1,3-dione, etc.; chroman; 1,4-dihydropyridines (for example, 2,6-dimethoxy-3,5-dicarboethoxy-1,4-dihydropyridine); bisphenols (for example, bis(2-hydroxy-3-t-butyl-5-methylphenyl)methane, bis(6-hydroxy-m-tri)mesitol, 2,2-bis(4-hydroxy-3-methylphenyl)propane, 4,5-ethylidene-bis(2-t-butyl-6-methyl)phenol, UV-sensitive ascorbic acid derivatives and 3-pyrazolidones.

Of these, particularly preferred reducing agents are hindered phenols.

As hindered phenols, listed are compounds represented by the general formula (A) described below.

General formula (A)

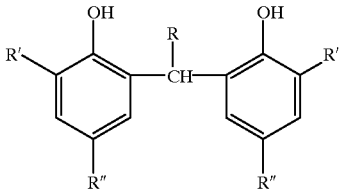

wherein R represents a hydrogen atom or an alkyl group having from 1 to 10 carbon atoms (for example, —$C_4H_9$, 2,4,4-trimethylpentyl), and R' and R" each represents an alkyl group having from 1 to 5 carbon atoms (for example, methyl, ethyl, t-butyl).

Specific examples of the compounds represented by the general formula (A) are described below.

A-1

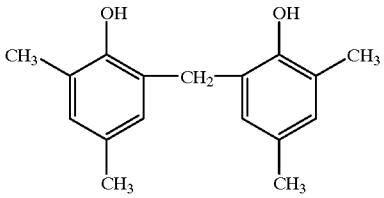

A-2

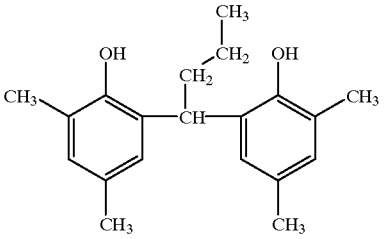

-continued

A-3

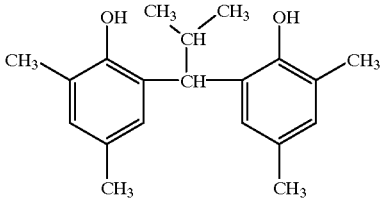

A-4

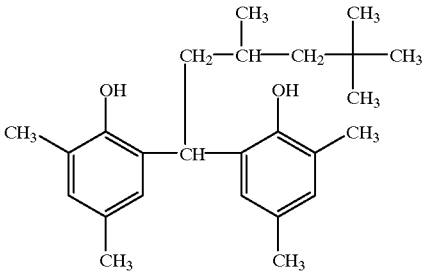

A-5

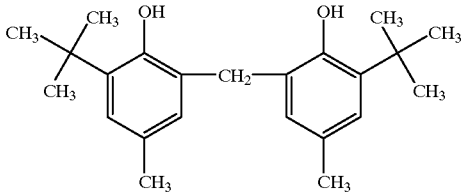

A-6

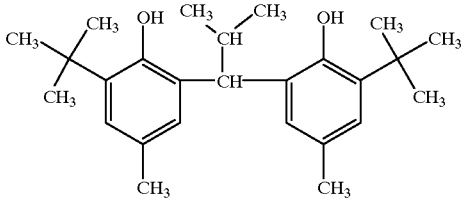

A-7

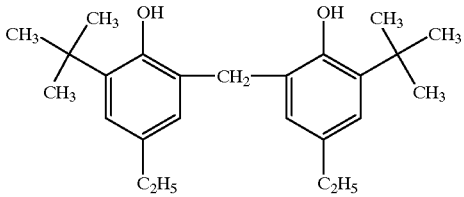

The used amount of reducing agents first represented by the above-mentioned general formula (A) is preferably between $1\times10^{-2}$ and 10 moles per mole of silver, and is most preferably between $1\times10^{-2}$ and 1.5 moles.

Binders suitable for the thermally developable photosensitive material to which the present invention is applied are transparent or translucent, and generally colorless. Binders are natural polymers, synthetic resins, and polymers and copolymers, other film forming media; for example, gelatin, gum arabic, poly(vinyl alcohol), hydroxyethyl cellulose, cellulose acetate, cellulose acetatebutylate, poly(vinyl pyrrolidone), casein, starch, poly(acrylic acid), poly(methylmethacrylic acid), poly(vinyl chloride), poly(methacrylic acid), copoly(styrene-maleic acid anhydride), copoly(styrene-acrylonitrile, copoly(styrene-butadiene, poly(vinyl acetal) series (for example, poly(vinyl formal)and poly(vinyl butyral), poly(ester) series, poly(urethane) series, phenoxy resins, poly(vinylidene chloride), poly(epoxide) series, poly(carbonate) series, poly(vinyl acetate) series, cellulose esters, poly(amide) series. These may be hydrophilic or hydrophobic.

The amount of the binder in a photosensitive layer is preferably between 1.5 and 10 g/m$^2$, and is more preferably between 1.7 and 8 g/m$^2$, with the purpose of minimizing the size variation after thermal development.

A matting agent is preferably incorporated into the photosensitive layer side. In order to minimize the image abrasion after thermal development, the matting agent is provided on the surface of a photosensitive material and the matting agent is preferably incorporated in an amount of 0.5 to 30 percent in weight ratio with respect to the total binder in the emulsion layer side.

Materials of the matting agents may be either organic substances or inorganic substances. Regarding inorganic substances, for example, those can be employed as matting agents, which are silica described in Swiss Patent No. 330,158, etc.; glass powder described in French Patent No. 1,296,995, etc.; and carbonates of alkali earth metals or cadmium, zinc, etc. described in U.K. Patent No. 1.173,181, etc.

Regarding organic substances, as organic matting agents those can be employed which are starch described in U.S. Pat. No. 2,322,037, etc.; starch derivatives described in Belgian Patent No. 625,451, U.K. Patent No. 981,198, etc.; polyvinyl alcohols described in Japanese Patent Publication No. 44-3643, etc.; polystyrenes or polymethacrylates described in Swiss Patent No. 330,158, etc.; polyacrylonitriles described in U.S. Pat. No. 3,079,257, etc.; and polycarbonates described in U.S. Pat. No. 3,022,169.

The shape of the matting agent may be crystalline or amorphous. However, a crystalline and spherical shape is preferably employed.

The size of a matting agent is expressed in the diameter of a sphere which has the same volume as the matting agent. The matting agent employed in the present invention preferably has an average particle diameter of 0.5 to 10 $\mu$m, and more preferably of 1.0 to 8.0 $\mu$m. Furthermore, the variation coefficient of the size distribution is preferably not more than 50 percent, is more preferably not more than 40 percent, and is most preferably not more than 30 percent.

The variation coefficient of the size distribution as described herein is a value represented by the formula described below.

(Standard deviation of grain diameter)/(average grain diameter)×100

The matting agent can be incorporated into arbitrary construction layers and is preferably incorporated into construction layers other than the photosensitive layer, and is more preferably incorporated into the farthest layer from the support surface.

The matting agent is incorporated by such way that the matting agent is previously dispersed into a coating composition and is then coated, and prior to the completion of drying, a matting agent is sprayed. When a plurality of matting agents are added, both methods may be employed in combination.

The thermally developable photosensitive material, to which the present invention is applied, is subjected to formation of photographic images employing thermal development processing and preferably comprises a reducible silver source (organic silver salt), silver halide with an catalytically active amount, a hydrazine derivative, a reducing agent and, if desired, an image color control agent, to adjust silver tone, which are generally dispersed into a (organic) binder matrix.

The thermally developable photosensitive material, to which the present invention is applied, is stable at normal temperatures and is developed, after exposure, when heated to not less than 250° C. Upon heating, silver is formed through an oxidation-reduction reaction between the organic silver salt (functioning as an oxidizing agent) and the reducing agent. This oxidation-reduction reaction is accelerated by the catalytic action of a latent image formed in the silver halide through exposure. Silver formed by the reaction with the organic silver salt in an exposed area yields a black image, which contrasts with an unexposed area to form an image. This reaction process proceeds without the further supply of a processing liquid such as water, etc. from outside.

In order to control the amount or wavelength distribution of light transmitted through the photosensitive layer, a filter layer may be provided on the same side as the photosensitive layer, or on the opposite side. Dyes or pigments may also be incorporated into the photosensitive layer. As the dyes, preferred are compounds described in Japanese Patent Publication Open to Public Inspection Nos. 59-6481, 59-182436, U.S. Pat. Nos. 4,271,263, 4,594,321, EP 533, 008 A, EP 652,437 A, Japanese Patent Publication Open to Public Inspection Nos. 2-216,140, 4-348,339, 7-191,432, 7-301890, and 8-201959. For gradation adjustment, in terms of sensitivity, layers may be constituted in such a manner as a fast layer/slow layer or a slow layer/fast layer.

Image color control agents are preferably incorporated into the thermally developable photosensitive material to which the present invention is applied. Examples of suitable image color control agents are disclosed in Research Disclosure Item 17029, and include the following;

imides (for example, phthalimide), cyclic imides, pyrazoline-5-ones, and quinazolinon (for example, succinimide, 3-phenyl-2-pyrazoline-5-one, 1-phenylurazole, quinazoline and 2,4-thiazolidione); naphthalimides (for example, N-hydroxy-1,8-naphthalimide); cobalt complexes (for example, cobalt hexaminetrifluoroacetate), mercaptans (for example, 3-mercapto-1,2,4-triazole); N-(aminomethyl) aryldicarboxyimides (for example, N-(dimethylaminomethyl)phthalimide); blocked pyrazoles, isothiuronium derivatives and combinations of certain types of light-bleaching agents (for example, combination of N,N'-hexamethylene(1-carbamoyl-3,5-dimethylpyrazole), 1,8-(3,6-dioxaoctane)bis (isothiuroniumtrifluoroacetate), and 2-(tribromomethylsulfonyl)benzothiazole; merocyanine dyes (for example, 3-ethyl-5-((3-ethyl-2-benzothiazolinylidene-(benzothiazolinylidene))-1-methylethylidene-2-thio-2,4-oxazolidinedione); phthalazinone, phthalazinone derivatives or metal salts thereof (for example, 4-(1-naphthyl)phthalazinone, 6-chlorophthalazinone, 5,7-dimethylphthalazinone, and 2,3-dihydro-1,4-phthalazinedione); combinations of phthalazinone and sulfinic acid derivatives (for example, 6-chlorophthalazinone+benzenesulfinic acid sodium or 8-methylphthalazinone+p-trisulfonic acid sodium); combinations of phthalazine+phthalic acid; combinations of phthalazine (including phthalazine addition products) with at least one compound selected from maleic acid anhydride, and phthalic acid, 2,3-naphthalenedicarboxylic acid or o-phenylenic acid derivatives and anhydrides thereof (for example, phthalic acid, 4-methylphthalic acid, 4-nitrophthalic acid, and tetra-chlorophthalic acid anhydride); quinazolinediones, benzoxazine, naphthoxazine derivatives, benzoxazine-2,4-diones (for example, 1,3-benzoxazine-2,4-dione); pyrimidines and asymmetrytriazines (for example, 2,4-dihydroxypyrimidine), and tetraazapentalene derivatives (for example, 3,6-dimercapto-1,4-diphenyl-1H, 4H-2,3a,5,6a-tatraazapentalene). Preferred image color control agents include phthalazone or phthalazine.

In order to control development, namely to retard or accelerate development, to improve the spectral sensitization efficiency, and to improve keeping quality before and after development, mercapto compounds, disulfide compounds, and thione compounds may be incorporated. When the mercapto compounds are used in the present invention, those having any structure may be employed. However, those represented by ArSM and Ar—S—S—Ar are preferred, wherein M represents a hydrogen atom or an alkali metal atom; Ar represents an aromatic ring or a condensed aromatic ring having at least one of a nitrogen, sulfur, oxygen, selenium or tellurium atom.

Preferably, the hetero-aromatic ring is benzimidazole, naphthoimidazole, benzothiazole, naphthothiazole, benzoxazole, naphthoxazole, benzoselenazole, benzotelluzole, imidazole, oxazole, pyrazole, triazole, thiadiazole, tetrazole, triazine, pyrimidine, pyridazine, pyrazine, pyridine, purine, quinoline, quinazoline.

This hetero-aromatic ring may comprise any of those selected from the substituent group consisting of, for example, halogen (for example, Br and Cl), hydroxy, amino, carboxy, alkyl (for example, having at least one carbon atom, or having preferably 1 to 4 carbon atoms), and alkoxy (for example, having at least one carbon atom, or having preferably 1 to 4 carbon atoms).

Mercapto substituted hetero-aromatic compounds include 2-mercaptobenzimidazole, 2-mercaptobenzoxazole, 2-mercaptobenzothiazole, 2-mercapto-5-methylbenzthiazole, 3-mercapto-5-phenyl-1,2,4-triazole, 2-mercaptoquinoline, 8-mercaptopurine, 2,3,5,6-tetrachloro-4-pyridinethiol, 4-hydroxy-2-mercaptopyrimidine, 2-mercapto-4-phenyloxazole, etc.

Antifoggants may be incorporated into the thermally developable photosensitive material. The substance which is known as the most effective antifoggant is a mercury ion. The incorporation of mercury compounds as the antifoggant into photosensitive materials is disclosed, for example, in U.S. Pat. No. 3,589,903. However, mercury compounds are not environmentally preferred. As mercury-free antifoggants, preferred are those antifoggants as disclosed in U.S. Pat. Nos. 4,546,075 and 4,452,885, and Japanese Patent Publication Open to Public Inspection No. 59-57234.

Particularly preferred mercury-free antifoggants are heterocyclic compounds having at least one substituent, represented by -C(X1 )(X2 )(X3 ) (wherein X1 and X2 each represents halogen, and X3 represents hydrogen or halogen), as disclosed in U.S. Pat. Nos. 3,874,946 and 4,756,999. As examples of suitable antifoggants, employed preferably are compounds and the like described in paragraph numbers [0062] and [0063] of Japanese Patent Publication Open to Public Inspection No. 9-90550.

Furthermore, more suitable antifoggants are disclosed in U.S. Pat. No. 5,028,523, and U.K. Patent Application Nos. 9221383.4, 9300147. 7, and 9311790. 1.

In the thermally developable photosensitive material to which the present invention is applied, employed can be sensitizing dyes described, for example, in Japanese Patent Publication Open to Public Inspection Nos. 63-159841, 60-140335, 63-231437, 63-259651, 63-304242, and 63-15245; U.S. Pat. Nos. 4,639,414, 4,740,455, 4,741,966, 4,751,175, and 4,835,096. Useful sensitizing dyes employed in the present invention are described, for example, in publications described in or cited in Research Disclosure Items 17643, Section IV-A (page 23, November 1978), 1831, Section X (page 437, August 1978). Particularly, selected can advantageously be sensitizing dyes having the spectral sensitivity suitable for spectral characteristics of light sources of various types of scanners. For example, compounds are preferably employed which are described in Japanese Patent Publication Open to Public Inspection Nos. 9-34078, 9-54409, and 9-80679.

The photosensitive material may contain, for example, surfactant, anti-oxidant, stabilizer, plasticizer, UV ray absorbent, coating aid and so on.

Supports are preferably, in order to obtain predetermined optical density after development processing and to minimize the deformation of images after development processing, plastic films (for example, polyethylene terephthalate, polycarbonate, polyimide, nylon, cellulose triacetate, polyethylene naphthalate).

Of these, as preferred supports, listed are polyethylene terephthalate (hereinafter referred to as PET) and other plastics (hereinafter referred to as SPS) comprising styrene series polymers having a syndiotactic structure. The thickness of the support is between about 50 and about 300 $\mu$m, and is preferably between 70 and 180 $\mu$m.

Furthermore, thermally processed plastic supports may be employed. As acceptable plastics, those described above are listed. The thermal processing of the support, as described herein, is that after film casting and prior to the photosensitive layer coating, these supports are heated to a temperature at least 30° C. higher than the glass transition point by not less than 30° C. and more preferably by at least 40° C.

EXAMPLE

The present invention will be detailed with reference to examples below.

Example 1

Preparation of the Photosensitive Coating Composition

Preparation of the Silver Halide Emulsion A

Dissolved in 40 liters of water are 1.3 kg of inert gelatin and 160 cc of 0.1M potassium bromide, and the temparature and pH of the resultant solution was adjusted to 35° C. and 3.0, respectively. Added to the solution were then 39 liters of an aqueous solution containing 4.5 kg of silver nitrate, an aqueous solution containing potassium bromide and potassium iodide in the mole ratio of 98/2, $1\times10^{-6}$ mole of $Ir(NO)C_5$ per mole of silver, and $1\times10^{-4}$ mole of rhodium chloride per mole of silver employing a controlled double jet method while maintaining the pAg at 7.7. Thereafter, 4-hydroxy-6-methyl-1,3,3a-tetraazaindne was added and the pH was adjusted to 5 employing NaOH. Thus, cubic silver iodobromide grains were prepared which had an average grain size of 0.06 $\mu$m, a variation coefficient of the projection diameter area of 8 percent, a ratio of a (100) plane of 87 percent. The resultant emulsion was coagulated employing a gelatin coagulant and after a desalting process, 4.2 g of phenoxyethanol was added and a silver halide emulsion was prepared by adjusting the pH and pAg to 5.9 and 7.5, respectively.

Next, $3\times10^{-2}$ mole of sodium thiosulfate per mole of silver was added to the resultant emulsion, which underwent chemical sensitization at 55° C. for 60 minutes. Thereafter, the silver halide emulsion was cooled to room temperature, added with an antifoggant, etc. described below, and photosensitive Silver Halide Emulsion A was prepared, which underwent chemical sensitization using chloroauric acid and inorganic sulfur.

Preparation of the Sodium Behenate Solution

Dissolved in 40 liters of deionized water were at 90° C. 1.4 kg of behenic acid, 0.42 kg of arachidic acid, 0.25 kg of stearic acid. Next, while stirring at high speed, 4.1 liters of a 1.5M sodium hydroxide solution were added. After adding 39 liters of concentrated nitric acid, the resultant mixture was cooled to 55° C. and stirred for 30 minutes and a sodium behenate solution was obtained.

Preparation of Silver Behenate, Silver Halide emulsion A, and Preform Emulsion

Added to the above-mentioned sodium behenate solution were 640 g of the above-mentioned silver Halide Emulsion A and the pH was adjusted to 8.1 employing an aqueous sodium hydroxide solution. Thereafter, 6.3 liters of a 1 M silver nitrate solution were added, were stirred for 20 minutes, and water-soluble salts were removed employing ultrafiltration. Resultant silver behenate was composed of grains having an average grain size of 0.8 $\mu$m and a dispersion degree of 8 percent. After forming flocculates from the dispersion, they were washed and dehydrated six times and subsequently dried.

Preparation of the Photosensitive Emulsion

Added to the resultant Preform Emulsion were gradually 23 kg of a polyvinyl butyral (having an average molecular weight of 3000) methyl ethyl ketone solution (of 17 weight percent) and 4.5 kg of toluene, and the resultant mixture was dispersed under 4000 psi.

The photosensitive layer coating composition having the composition described below were prepared employing the resultant dispersion.

| | |
|---|---|
| Methyl ethyl ketone | 70 weight % |
| Photosensitive emulsion dispersion | 22.8 weight % |
| Sensitizing dye-1 | 0.16 weight % |
| Pyridiniumbromideperbormide | 0.29 weight % |
| Calcium bromide | 0.16 weight % |
| antifoggant-1 | 0.11 weight % |
| 2-(4-chlorobenzoyl)benzoic acid | 0.87 weight % |
| 2-Mercaptobenzimidazole | 1.05 weight % |
| Tribromomethylsulfoquinoline | 1.62 weight % |
| A-4 | 2.82 weight % |

Sensitizing dye-1

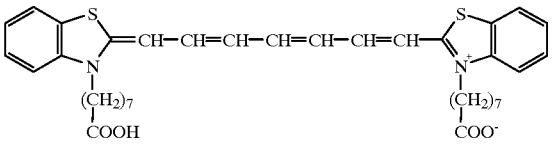

-continued

Antifoggant-1

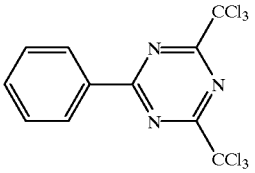

Preparation of the Protective Layer

The protective layer coating composition having the composition described below was prepared.

| | |
|---|---|
| Methyl ethyl ketone | 82.7 weight % |
| Cellulose acetate | 4.61 weight % |
| Methanol | 11.0 weight % |
| Phthalazine | 0.50 weight % |
| 4-Methylphthalic acid | 0.36 weight % |
| Tetrachlorophthalic acid | 0.30 weight % |
| Tetrachlorophthalic anhydride | 0.34 weight % |
| Monodisperse silica matting agent (degree of monodispersion of 10% and average particle size of 4 $\mu$m) | 0.14 weight % |
| $C_9H_{17}$—$C_6H_4$—$SO_3Na$ | 0.02 weight % |

Coating Test 1

Under conditions shown in Table 1, a photosensitive layer coating composition and a protective layer coating composition were coated onto a 100 $\mu$m thick biaxially stretched thermally fixed PET film base targeting a wet layer thickness of 100 $\mu$m and 40 $\mu$m, respectively, and coatability and foreign matter defects were evaluated.

TABLE 1

Figure 2:
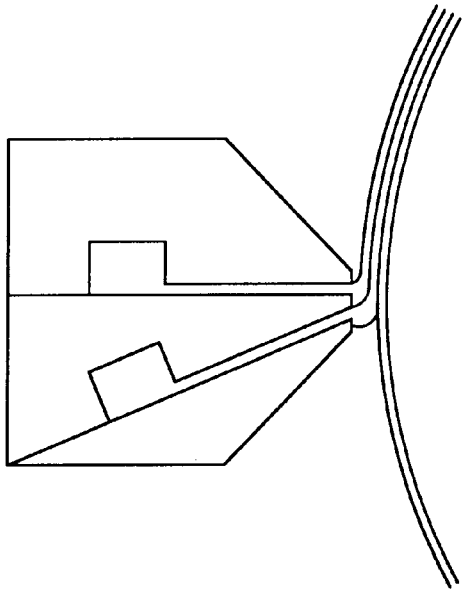
FIG. 2 is a schematic view showing a method in which layers ejected from two slits of an extrusion-type die coater are laminated and coated onto a support which is supported on the reverse side.

| | | | Main Solvent | | Viscosity of Coating Composition (Pa · s) | | Coatability | Foreign |
|---|---|---|---|---|---|---|---|---|
| | Coating Method | I | Photo-sensitive Layer | Protective Layer | Photo-sensitive Layer | Protective Layer | (mixing between layers) | Matter Defects (number/m$^2$) |
| Experiment 1 | FIG. 1 | 8 | MEK | MEK | 0.228 | 0.184 | good | 0.3 |
| Experiment 2 | FIG. 2 | 8 | MEK | MEK | 0.228 | 0.184 | good | 0.2 |
| Experiment 3 | Successive Coating | — | MEK | MEK | 0.228 | 0.184 | good | 1.6 |
| Experiment 4 | FIG. 2 | 8 | MEK | MEK | 0.228 | 0.082 | mixing between layers | 0.2 |
| Experiment 5 | FIG. 2 | 8 | MEK | MEK | 0.018 | 0.184 | mixing between layers | 0.2 |
| Experiment 6 | FIG. 2 | 8 | MEK | MEK | 0.425 | 0.539 | best | 0.2 |

I: Time between Coating Completion and Introduction to Thermal Drying (seconds)

※ MEK: methyl ethyl ketone MeOH: methanol

※ the coating composition, in which a major solvent is MEK, is a coating composition described in the composition-preparing method; the coating composition comprising MEOH is a coating composition in which MEK is replaced with MeOH ※ in Experiment 4, the protective layer coating composition in Experiment 2 was diluted with MEK and was subjected to decrease in the viscosity ※ in Experiment 5, the photosensitive layer in Experiment 2 was diluted with MEK and was subjected to decrease in the viscosity In Experiment 1, the coatability was good, however, defects due to foreign matter contaminated from the outside slightly increased compared to Experiment 2. It was found that based on the cross-sectional photograph of the obtained sample, the foreign matter adhered after coating the photosensitive layer and prior to coating the protective layer.

In Experiment 2, the coatability was good and almost no foreign matter defect resulted.

Experiment 3 was one in which after coating the photosensitive layer and drying it, the protective layer coating composition was coated and subsequently dried, and its coatability was good, however, many foreign matter defects resulted to degrade the product yield.

In Experiments 4 and 5, mixing between layers during the period after coating and until completing drying occurred due to the low viscosity of the protective layer of no more than 0.1 Pa.s and the low viscosity of the photosensitive layer of no more than 0.03 Pa.s, respectively, and it was impossible to separate the function of both layers.

In Experiment 6, in which the viscosity of the photosensitive layer was in the range of 0.3 to 0.7 Pa.s and the viscosity of the protective layer was in the range of 0.2 to 0.6 Pa.s, the boundary of both layers was clear and no mixing between layers was observed. Further, it was possible to carry out stable coating without coating problems.

When adjusting the viscosity of the photosensitive layer to at least 0.7 Pa.s and the viscosity of the protective layer to at least 1 Pa.s, it was possible to carry out coating with neither mixing between layers nor coating problems. However, because load is applied to the liquid-conveying facilities, it becomes necessary to construct large-scaled facilities.

Furthermore, the viscosity of the coating composition in each Experiment is shown in Table 2.

TABLE 2

| | Viscosity of Photosensitive Layer Coating Composition (Pa · s) | | | Viscosity of Protective Layer Coating Composition (Pa · s) | | |
|---|---|---|---|---|---|---|
| | Shear Rate 100 $S^{-1}$ | Shear Rate 400 $S^{-1}$ | Shear Rate 1000 $S^{-1}$ | Shear Rate 100 $S^{-1}$ | Shear Rate 400 $S^{-1}$ | Shear Rate 1000 $S^{-1}$ |
| Experiment 1 | 0.249 | 0.228 | 0.216 | 0.204 | 0.184 | 0.172 |
| Experiment 2 | 0.249 | 0.228 | 0.216 | 0.204 | 0.184 | 0.172 |
| Experiment 3 | 0.249 | 0.228 | 0.216 | 0.204 | 0.184 | 0.172 |
| Experiment 4 | 0.249 | 0.228 | 0.216 | 0.099 | 0.082 | 0.076 |
| Experiment 5 | 0.021 | 0.018 | 0.017 | 0.204 | 0.184 | 0.172 |
| Experiment 6 | 0.466 | 0.425 | 0.398 | 0.602 | 0.539 | 0.501 |

Furthermore, Table 3 shows conditions of slit gap, manifold pressure, and gap between the support and the coater lip in Experiment 2.

In Experiment 2 as shown above, each slit gap was between 50 and 400 $\mu$m, the manifold pressure was between 10 and 500 kPa, and further, the gap between the support surface and the coater lip was between 1.1 and 1.9 times as much as the total wet layer thickness. As a result, in addition to effects demonstrated in Table 1, as shown in Table 2, coatability (in addition to properties of mixing between layers in Table 1, liquid-conveying properties are excellent, no streak unevenness occurs in the conveying direction and no non-coating layer results), and it is possible to improve the layer thickness distribution in the crosswise direction.

TABLE 3

| | Slit Opening ($\mu$m) | | Manifold (kPa) | | Gap between Support and Coater/ Total Layer Thickness of 2 Layers | Coatability | Crosswise Distribution |
|---|---|---|---|---|---|---|---|
| | Photo-sensitive Layer | Protective Layer | Photo-sensitive Layer | Protective Layer | | | |
| Experiment 2 | 150 | 100 | 270 | 290 | 1.5 | good | good |

According to the present invention, by coating a plurality of functional layers composed of organic solvent-based coating compositions employing a simultaneous multilayer coating method, function can securely be separated.

What is claimed is:

1. A method for the formation, by extrusion coating, of at least two layers, including a first layer and a second layer, said first layer in contact with a support and said second layer on said first layer and in contact therewith, a first of said coating compositions containing at least two different solvents, a second of said coating compositions containing at least two different solvents, one of said solvents being common to both said first coating composition and said second coating composition, an amount of said common solvent being greater than a sum of the other solvents, whereby said coating compositions are coated on said support, said method comprising applying said second layer on said first layer before said first layer has dried, a farthest layer from said support having a viscosity of at least 0.1 Pa.s during coating, the viscosity of other layers than said farthest layer being at least 0.03 Pa.s.

2. The multilayer coating method of claim 1 wherein said coating compositions satisfy the formula described below:

$$\mu 1/\mu 2<2$$

wherein $\mu 1$ represents the viscosity of the coating composition at a shear rate of A1 at 25° C., and $\mu 2$ represents the viscosity of the coating composition at a shear rate of A2 at 25° C., and A1 <A2 .

3. The multilayer coating method of claim 2 wherein said A1 is 100 $S^{-1}$ and said A2 is at least 200 $S^{-1}$.

4. The multilayer coating method of claim 3 wherein said A2 is 400 $S^{-1}$.

5. The multilayer coating method of claim 2 wherein the viscosity of coating composition for said farthest layer is between 0.1 and 1 Pa.s during coating.

6. The multilayer coating method of claim 5 wherein the viscosity of coating composition of said other layers is between 0.03 and 0.7 Pa.s during coating.

7. The multilayer coating method of claim 6 wherein a manifold pressure in an extrusion die coater for said coating compositions is 10 to 500 kPa.

8. The multilayer coating method of claim 6 wherein a coating composition of said farthest layer, having a viscosity of 0.1 to 1 Pa.s during coating, and a coating composition of said other layers having a viscosity of 0.03 to 0.7 Pa.s during coating, are ejected from two slits having a width of 50 to 400 $\mu$m of said extrusion die coater onto said support so as to obtain a total wet thickness of 50 to 200 $\mu$m.

9. The multilayer coating method of claim 2 wherein absolute value of the difference between viscosity of the coating composition of said farthest layer during coating and viscosity of the coating composition of the said other layers during coating is no more than 0.3 Pa.s.

10. The multilayer coating method of claim 2 wherein shear rate of said coating compositions during coating is between 200 and 500 $S^{-1}$.

11. The multilayer coating method of claim 2 wherein each of said coating composition is ejected from a slit of an extrusion die coater onto the support.

12. The multilayer coating method of claim 2 wherein the viscosity of coating compositions of said other layers is between 0.03 and 0.7 Pa.s during coating.

13. The multilayer coating method of claim 12 wherein the viscosity of the coating composition of said farthest layer is between 0.3 and 0.7 Pa.s during coating and the viscosity of the coating compositions of said other layers is between 0.2 and 0.6 Pa.s.

14. The multilayer coating method of claim 2 which comprises commencing drying of said at least said two layers within 10 seconds after coating said coating compositions.

15. The multilayer coating method of claim 1 wherein a second layer coating composition, having a viscosity of 0.1 to 1 Pa.s during coating, and a first layer coating composition, having a viscosity of 0.03 to 0.7 Pa.s during coating, are ejected from two slits of an extrusion die coater onto a support which is supported on the reverse side, a gap between the surface of said support and a lip of said die coater being adjusted to be 1.1 to 1.9 times as much as the total wet thickness.

16. A production method for a thermally developable photosensitive material according to claim 1 wherein, coating is carried out in such a manner that of two slits of the extrusion type die coater, the photosensitive coating composition is ejected from the slit which is arranged on the up-stream side in the support-conveying direction and a protective layer coating composition is ejected from the slit arranged on the down-stream side.

* * * * *